US011805961B2

(12) United States Patent
Friedke et al.

(10) Patent No.: US 11,805,961 B2
(45) Date of Patent: Nov. 7, 2023

(54) DOMESTIC DISHWASHING MACHINE AND METHOD

(71) Applicant: BSH Hausgeräte GmbH, Munich (DE)

(72) Inventors: Aaron Friedke, Gundelfingen (DE); Martin Rittner, Welden (DE); Michael Rupp, Holzheim (DE)

(73) Assignee: BSH Hausgeräte GmbH, Munich (DE)

( * ) Notice: Subject to any disclaimer, the term of this patent is extended or adjusted under 35 U.S.C. 154(b) by 10 days.

(21) Appl. No.: 17/638,224

(22) PCT Filed: Sep. 17, 2020

(86) PCT No.: PCT/EP2020/075945
§ 371 (c)(1),
(2) Date: Feb. 25, 2022

(87) PCT Pub. No.: WO2021/058364
PCT Pub. Date: Apr. 1, 2021

(65) Prior Publication Data

US 2022/0322911 A1 Oct. 13, 2022

(30) Foreign Application Priority Data

Sep. 25, 2019 (DE) ..... 10 2019 214 619.8

(51) Int. Cl.
*A47L 15/42* (2006.01)

(52) U.S. Cl.
CPC ..... *A47L 15/4261* (2013.01); *A47L 15/4259* (2013.01); *A47L 2501/26* (2013.01)

(58) Field of Classification Search
None
See application file for complete search history.

(56) References Cited

U.S. PATENT DOCUMENTS

| | | | | |
|---|---|---|---|---|
| 11,547,269 | B2 * | 1/2023 | Friedke | F24C 15/023 |
| 2003/0084928 | A1 | 5/2003 | Wood | |
| 2007/0163626 | A1 | 7/2007 | Klein | |
| 2020/0093346 | A1 | 3/2020 | Lutz | |
| 2020/0263478 | A1 | 8/2020 | Yaman | |
| 2020/0281438 | A1 | 9/2020 | Friedke | |

FOREIGN PATENT DOCUMENTS

| | | | | |
|---|---|---|---|---|
| DE | 102005028448 | A1 | 12/2006 | |
| DE | 102011050914 | A1 | 12/2012 | |
| DE | 102017218493 | A1 * | 4/2019 | A47L 15/4259 |
| EP | 0541974 | A1 | 5/1993 | |
| EP | 0838192 | A1 | 4/1998 | |
| WO | 2010139536 | A1 | 12/2010 | |

OTHER PUBLICATIONS

Natinal Search Report DE 102019214619.8 dated Jul. 6, 2020.
International Search Report PCT/EP2020/075945 dated Nov. 25, 2020.

* cited by examiner

*Primary Examiner* — Rita P Adhlakha
(74) *Attorney, Agent, or Firm* — Michael E. Tschupp; Andre Pallapies; Brandon G Braun

(57) ABSTRACT

A household dishwasher includes a dishwasher cavity, a door attached pivotably to the dishwasher cavity, a door opening and closing device for automated opening and closing of the door, and a control unit designed to actuate the door opening and closing device. The control unit is designed to detect a motor current of a drive element of the door opening and closing device and to evaluate the detected motor current as to whether the door opening and closing device is functional or non-functional.

7 Claims, 6 Drawing Sheets

DOMESTIC DISHWASHING MACHINE AND METHOD

CROSS-REFERENCES TO RELATED APPLICATIONS

This application is the U.S. National Stage of International Application No. PCT/EP2020/075945, filed Sep. 17, 2020, which designated the United States and has been published as International Publication No. WO 2021/058364 A1 and which claims the priority of German Patent Application, Serial No. 10 2019 214 619.8, filed Sep. 25, 2019, pursuant to 35 U.S.C. 119(a)-(d).

The contents of International Application No. PCT/EP2020/075945 and German Patent Application, Serial No. 10 2019 214 619.8 are incorporated herein by reference in their entireties as if fully set forth herein.

BACKGROUND OF THE INVENTION

The present invention relates to a household dishwasher and a method for operating such a household dishwasher.

A dishwasher comprises a dishwasher cavity in which items to be washed can be received. A door is attached rotatably to the dishwasher cavity in order to close and open the dishwasher cavity. A spring-pretensioned cable system can be used for the automated opening and closing of the door. It is advantageous for the cable system to be monitored in order to prevent a user from being injured by an uncontrolled opening of the door in the event that the cable system is damaged.

DE 10 2011 050 914 A1 shows a dishwasher with a machine base and a dishwasher cavity providing a dishwasher interior, wherein the dishwasher cavity has a dishwasher interior access opening which can be closed by means of a pivotable door, and with a door spring, one end of which is arranged on the door with a cable pull disposed therebetween and the other end of which is arranged on the machine base. So as to provide enhanced operating safety with regard to the door spring, the dishwasher comprises a breakage sensor for the door spring.

BRIEF SUMMARY OF THE INVENTION

Against this background, one object of the present invention consists in providing an improved household dishwasher.

Accordingly, a household dishwasher with a dishwasher cavity, a door attached pivotably to the dishwasher cavity, a door opening and closing device for the automated opening and closing of the door, and a control unit for actuating the door opening and closing device is proposed. Here, the control unit is designed to detect a motor current of a drive element of the door opening and closing device and, on this basis, to evaluate whether the door opening and closing device is functional or non-functional.

The monitoring of the motor current advantageously makes it possible to dispense with a separate switch or sensor for monitoring the door opening and closing device in the household dishwasher. In this way, it is possible to reliably prevent a user from being injured by a door falling open uncontrollably in the event that the door opening and closing device is defective.

The dishwasher cavity is preferably cuboid in shape and has a loading opening on the front side for loading the household dishwasher with items to be washed, which loading opening can be closed and opened again with the aid of the door. The dishwasher cavity is supported by a box-shaped base carrier. The door opening and closing device is arranged at least partially in the base carrier. The door can be opened and closed automatically with the aid of the door opening and closing device. However, the door can preferably also be opened and closed manually. The door being "attached" to the dishwasher cavity means that said door is fastened pivotably to the dishwasher cavity, to the base carrier or to a housing of the household dishwasher with the aid of a hinge.

The control unit can be part of the door opening and closing device. Washing programs of the household dishwasher can also be stored in the control unit. Here, "stored" in relation to the control unit means that the washing programs or also other programs, such as for example a program for evaluating the motor current, are saved in the control unit. For this purpose, the control unit can have a memory module. The control unit can comprise a microprocessor or the like for detecting and evaluating the motor current. The suitability of the control unit for detecting and evaluating the motor current is due to the presence of suitable electronic components, for example the aforementioned microprocessor, and a program stored in the control unit for detecting and/or evaluating the motor current. In particular, the control unit comprises a motor characteristic curve of the drive element. Here, a "motor characteristic curve" is to be understood to mean the course of the motor current over time.

The drive element is preferably part of the door opening and closing device. The drive element can be an electric motor. In addition to the drive element, the door opening and closing device preferably comprises a spring element and a cable coupled to the spring element and to the door. The drive element is preferably connected actively to the cable such that the drive element drives the cable. The non-functionality of the door opening and closing device can result for example from a breakage of the spring element and/or the cable. Non-functionality can also result from a loss of the pretensioning of the spring element. Apart from the aforementioned components, however, other components of the door opening and closing device can also result in the non-functionality of the same. This, too, can be identified.

The evaluation of the motor current can take place such that the detected motor current is compared with a value stored in the control unit, for example a limit value or a reference motor characteristic curve. If for example the detected motor current is lower than a setpoint value, the control unit can assume that the spring element and/or the cable is broken since the drive element then rotates freely without a load, resulting in a lower motor current than in the case of a functional door opening and closing device.

According to one embodiment, the control unit is designed to output a signal and/or to deactivate the door opening and closing device in the event that the door opening and closing device is non-functional.

The signal can be for example a warning signal which is output via a user interface. The signal can be visual and/or acoustic. The door can be opened and closed manually even if the door opening and closing device is deactivated.

According to a further embodiment, the door opening and closing device has a cable coupled to the door and a spring element coupled to the cable, wherein the control unit is designed to evaluate the motor current in order to establish whether the cable and/or the spring element is functional or non-functional.

The drive element can be connected actively to the cable for opening and closing the door. The drive element can however also be coupled to the door in a different manner such that the cable and the spring element are not necessarily an integral part of the door opening and closing device.

According to a further embodiment, the household dishwasher further comprises a drive roller, driven by the drive element, around which the cable is wrapped so as to be driven.

The drive roller can have a cylindrical friction surface on which the cable is wound up preferably with 1.25 windings. Force is transmitted from the drive roller to the cable by means of friction.

According to a further embodiment, the control unit is designed to actuate the drive element in a closed state of the door and to detect and evaluate the motor current in the closed state of the door.

For this purpose, the door is closed manually or automatically. Here, the door can be locked with the aid of a door safety lock. The door safety lock can be actuated by the control unit.

According to a further embodiment, the control unit is designed to compare a motor characteristic curve of the drive element with a reference motor characteristic curve stored in the control unit and/or a limit value stored in the control unit and to identify, as a function of a deviation of the motor characteristic curve from the reference motor characteristic curve and/or the limit value, whether the door opening and closing device is functional or non-functional.

The limit value is a limit value of the motor current. The limit value can therefore also be referred to as the motor current limit value. As mentioned previously, a "motor characteristic curve" is to be understood to mean the course of the motor current over time. A tolerance range for the reference motor characteristic curve can be stored in the control unit. If the determined motor characteristic curve lies within this tolerance range, the control unit assumes that the door opening and closing device is intact. If the determined motor characteristic curve lies outside this tolerance range, the control unit assumes that the door opening and closing device is defective. A similar rule applies to the motor current limit value. If the determined motor characteristic curve lies below the limit value, it can be assumed that the drive element is rotating freely and the spring element and/or the cable are broken. If the motor characteristic curve lies above the limit value, it can be assumed that the door opening and closing device is intact.

According to a further embodiment, the household dishwasher further comprises a user interface for operating the door opening and closing device and for outputting a signal indicating whether the door opening and closing device is functional or non-functional.

The user interface preferably comprises a pushbutton, a touch display, a microphone, a sensor or some other input facility. The user interface is also suitable for outputting a notification, for example in the form of a visual and/or acoustic signal.

Furthermore, a method for operating such a household dishwasher is proposed. The method comprises the following steps: a) closing the door, b) actuating the drive element when the door is closed, c) detecting the motor current of the drive element, and d) evaluating the motor current in order to establish whether the door opening and closing device is functional or non-functional.

In step a), the door can be closed manually or automatically with the aid of the door opening and closing device. Steps b) to d) are carried out in particular with the aid of the control unit.

According to one embodiment, in step d) a motor characteristic curve of the drive element is compared with a reference motor characteristic curve stored in the control unit and/or a limit value stored in the control unit.

As explained previously, the extent to which the detected motor characteristic curve deviates from the reference motor characteristic curve or from the limit value is used to determine whether the door opening and closing device is functional or non-functional.

According to a further embodiment, the reference motor characteristic curve is stored in the control unit during a calibration procedure of the household dishwasher.

The calibration procedure can be carried out for example during the commissioning of the household dishwasher. The calibration procedure can also be repeated again and again at predetermined time intervals.

The embodiments and features described for the household dishwasher apply correspondingly to the proposed method and vice versa.

Further possible implementations of the household dishwasher and/or of the method also comprise combinations—not explicitly mentioned—of features or embodiments described above or below in respect of the exemplary embodiments. In such cases the person skilled in the art will also add individual aspects as improvements or amendments to the respective basic form of the household dishwasher and/or of the method.

BRIEF DESCRIPTION OF THE DRAWINGS

Further advantageous embodiments and aspects of the household dishwasher and/or of the method form the subject matter of the dependent claims and of the exemplary embodiments of the household dishwasher and/or of the method described below. The household dishwasher and/or the method are further explained in greater detail below on the basis of preferred embodiments with reference to the appended figures.

DETAILED DESCRIPTION OF EXEMPLARY EMBODIMENTS OF THE PRESENT INVENTION

Figure 1:
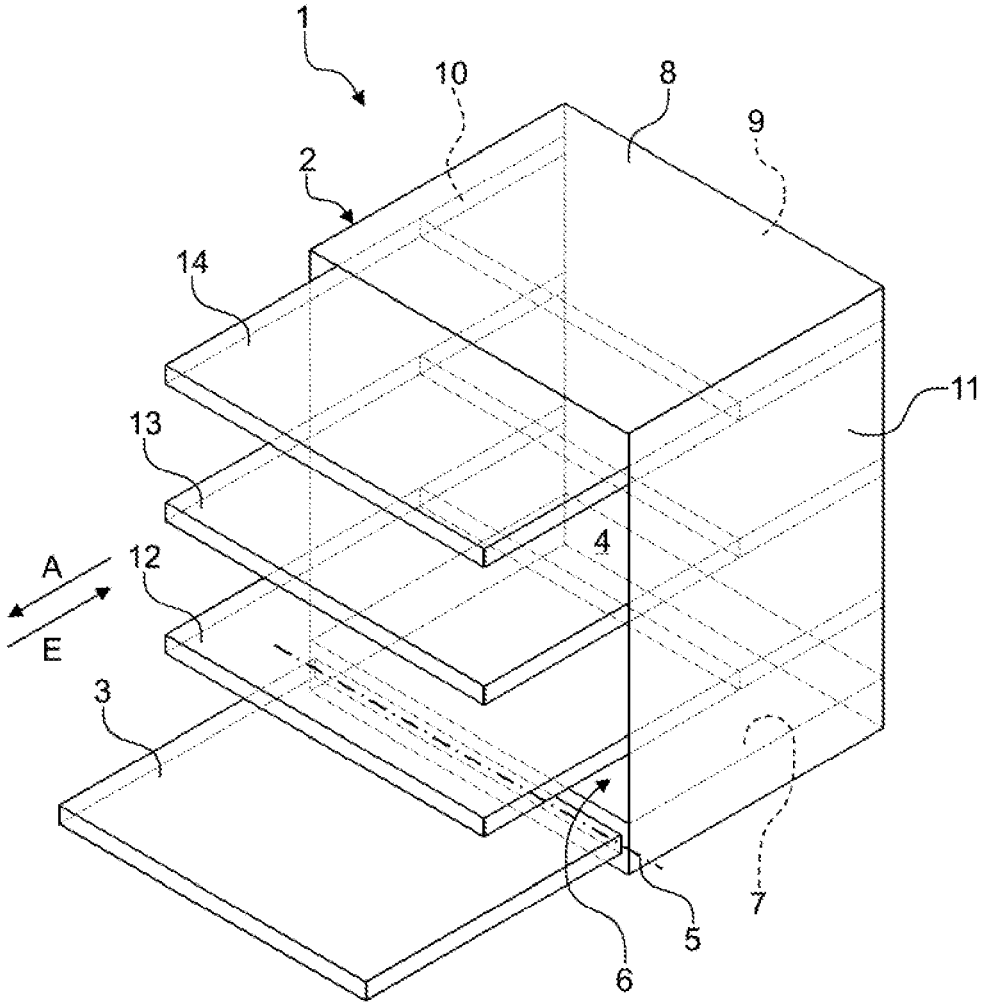
FIG. 1 shows a schematic perspective view of an embodiment of a household dishwasher.

In the figures, elements that are identical or have the same function have been provided with the same reference characters unless otherwise stated.

FIG. 1 shows a schematic perspective view of an embodiment of a household dishwasher 1. The household dishwasher 1 comprises a dishwasher cavity 2, which can be closed by a door 3, in particular in a watertight manner. A sealing device can be provided for this purpose between the door 3 and the dishwasher cavity 2. The dishwasher cavity 2 is preferably cuboid in shape. The dishwasher cavity 2 can be arranged in a housing of the household dishwasher 1. The dishwasher cavity 2 and the door 3 can form a dishwasher interior 4 for washing items to be washed.

The door 3 is shown in its open position in FIG. 1. The door 3 can be closed or opened by pivoting about a pivot axis 5 provided on a lower end of the door 3. A loading opening 6 of the dishwasher cavity 2 can be closed or opened with the aid of the door 3. The dishwasher cavity 2 has a base 7, a ceiling 8 arranged facing the base 7, a rear wall 9 arranged facing the closed door 3, and two side walls 10, 11 arranged facing one another. The base 7, the ceiling 8, the rear wall 9 and the side walls 10, 11 can be manufactured from a stainless-steel sheet, for example. Alternatively, the base 7 can be manufactured from a plastic material, for example.

Furthermore, the household dishwasher 1 has at least one receptacle for items to be washed 12 to 14. A number of, for instance three, receptacles for items to be washed 12 to 14 can preferably be provided, wherein the receptacle for items to be washed 12 can be a lower receptacle for items to be washed or a bottom basket, the receptacle for items to be washed 13 can be an upper receptacle for items to be washed or an upper basket, and the receptacle for items to be washed 14 can be a cutlery drawer. As additionally shown in FIG. 1, the receptacles for items to be washed 12 to 14 are arranged one above the other in the dishwasher cavity 2. Each receptacle for items to be washed 12 to 14 is optionally able to be shifted into or out of the dishwasher cavity 2. In particular, each receptacle for items to be washed 12 to 14 is able to be inserted or pushed into the dishwasher cavity 2 in an insertion direction E and extracted or pulled out from the dishwasher cavity 2 in an extraction direction A counter to the insertion direction E.

Figure 2:
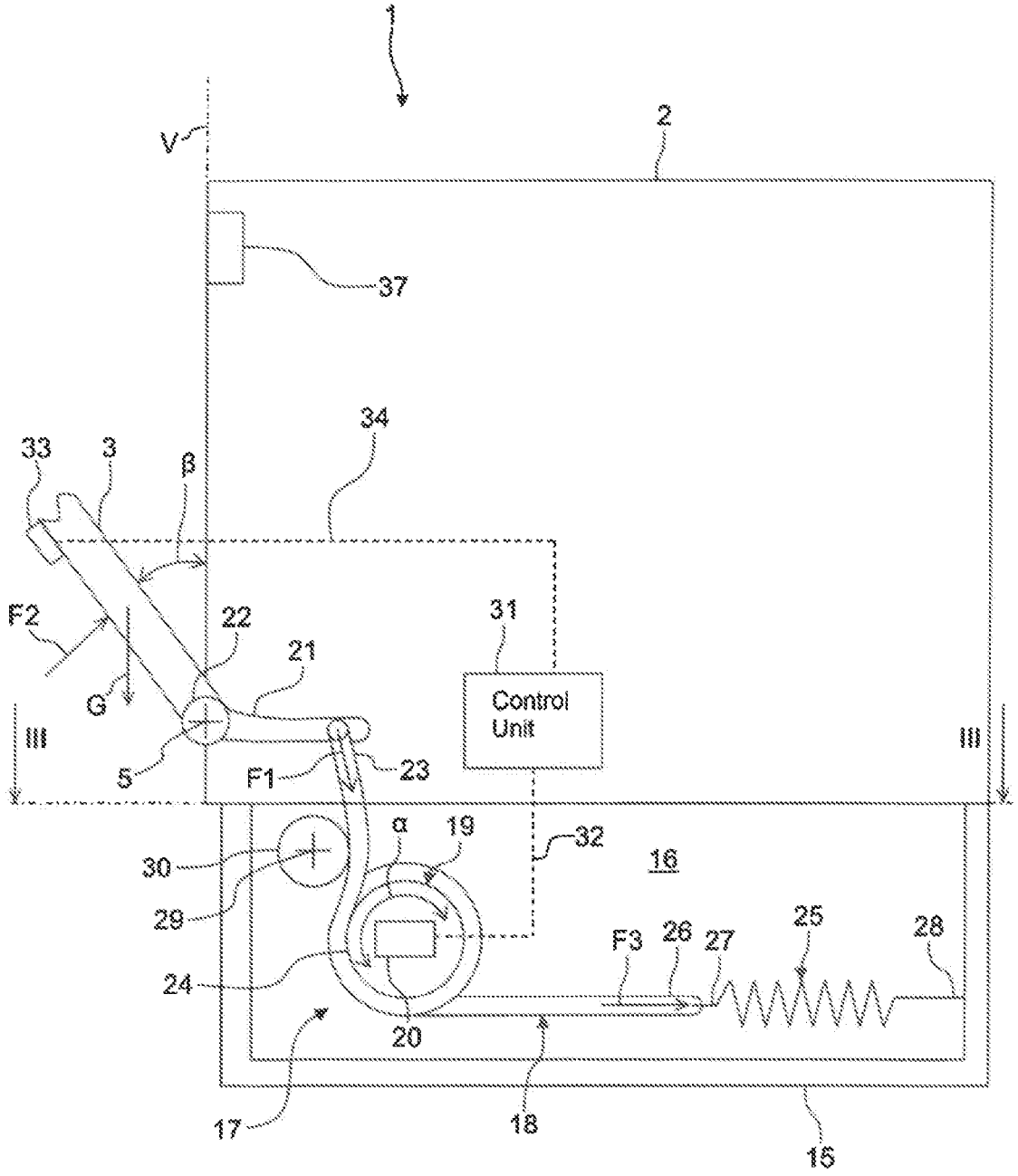
FIG. 2 shows a schematic sectional view of the household dishwasher according to FIG. 1.
Figure 3:
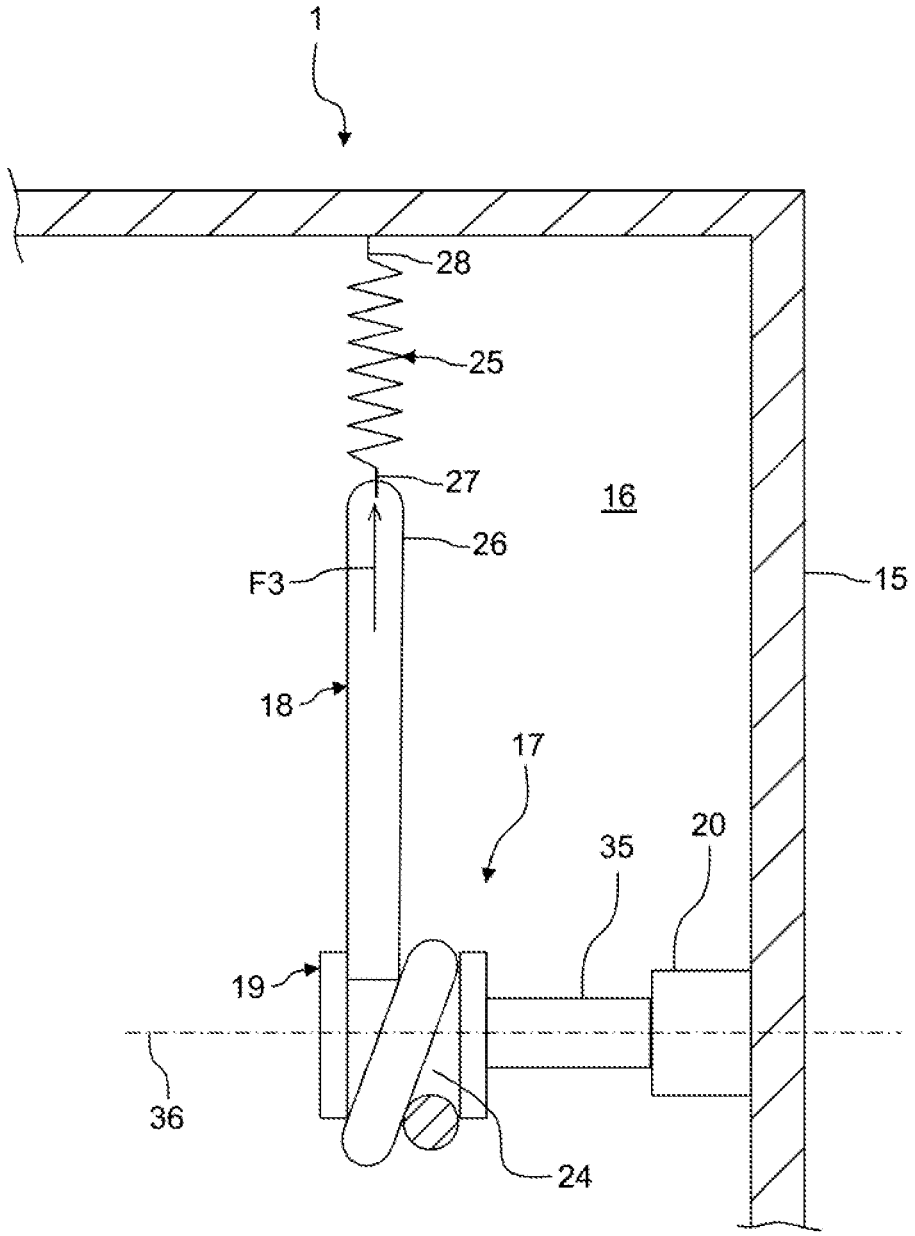
FIG. 3 shows a further schematic sectional view of the household dishwasher according to the section line III-III in FIG. 2.

FIG. 2 shows a schematic sectional view of the household dishwasher 1. FIG. 3 shows a further schematic sectional view of the household dishwasher 1 according to the section line III-III in FIG. 2. Here, the sectional view according to FIG. 3 is rotated by 90° in the clockwise direction compared to the sectional view according to FIG. 2. Reference is made below simultaneously to FIGS. 2 and 3.

The household dishwasher 1 comprises a base carrier 15, which supports the dishwasher cavity 2. The base carrier 15 can be a plastic injection-molded component. The base carrier 15 encloses an interior 16 of the same. A door opening and closing device 17 can be received in the interior 16. Here, the door opening and closing device 17 comprises a cable 18 connected to the door 3, a drive roller 19 in contact with the cable 18, and a drive element 20, for example an electric motor, which is designed to drive the drive roller 19 in order to move the cable 18 such that a pivoting movement of the door 3 is effected.

The door 3 further comprises a lever section 21 to which a first end section 23 of the cable 18 is connected. The door 3, the drive element 20 and the cable 18 are designed such that a change in a tensile force F1 exerted on the lever section 21 with the aid of the drive element 20 and the cable 18 effects the pivoting movement of the door 3. For this purpose, the drive roller 19 is connected actively to the drive element 20.

The door 3 is attached pivotably to the dishwasher cavity 2, the base carrier 15 or a housing (not shown) of the household dishwasher 1 with the aid of a hinge 22, for example. Here, the pivot axis 5 is assigned to the hinge 22. The drive roller 19 and the cable 18 are designed such that a transmission of drive force from the drive roller 19 to the cable 18 takes place exclusively with the aid of a friction force-fit. For this purpose, a friction surface 24 of the drive roller 19 is embodied between the drive roller 19 and the cable 18. The friction surface 24 can be circular-cylindrical in shape.

The cable 18 has a wrap angle $\alpha$ around the drive roller 19 of between 360° and 540°, preferably between 400° and 500°, further preferably between 425° and 475° and even more preferably between 445° and 455°. For example, the wrap angle $\alpha$ is precisely 450°. This can also be referred to as 1.25 cable windings around the drive roller 19. Advantageously with such a wrap angle $\alpha$ the maximum tensile force F1 which pulls on the lever section 21 can be set or limited.

Furthermore, the door opening and closing device 17 comprises a spring element 25, which is connected to the base carrier 15 and to the cable 18 and is designed to compensate at least partially for a weight G of the door 3. Here, a second end section 26 of the cable 18 is connected to the spring element 25. For example, the spring element 25 is embodied as a coil spring or cylindrical spring and in particular as a tensile spring. The spring element 25 comprises a first end section 27, which is connected to the second end section 26 of the cable 18. The spring element 25 further comprises a second end section 28, which is permanently connected to the base carrier 15. If the drive element 20 now drives the drive roller 19 such that the door 3 completes an opening movement, the spring element 25 is elongated.

The household dishwasher 1 also comprises a deflection roller 30, which is rotatable about an axis of rotation 29 and is designed to deflect the cable 18 between the drive roller 19 and the door 3. A course of the cable 18, for example, can be configured with the aid of the deflection roller 30. For example, with the aid of the use of the deflection roller 30 the wrap angle $\alpha$ can be increased or adapted to the basic geometric conditions of the base carrier 15.

Furthermore, the cable 18 and the drive roller 19 are designed such that when an opening angle $\beta$ of the door 3 is changed by a manual force F2 acting on the door 3 the cable 18 slides over the drive roller 19. This takes place in particular if the load on the spring element 25 is abruptly relieved, in particular in the event of a rapid closing of the door 3 by means of the manual force F2, and a spring force F3 pulls on the second end section 26 of the cable 18 when the drive roller 19 is locked. The opening angle $\beta$ here is an angle which is spanned between the door 3 and a vertical plane V through which the pivot axis 5 runs. The door opening and closing device 17 is for example designed such that an interaction of spring force F3 and weight G of the door 3 at each opening angle $\beta$ of the door 3 enables slip-free winding of the cable 18 onto the drive roller 19 and unwinding of the cable 18 from the drive roller 19.

The door opening and closing device 17 further comprises a control unit 31, which is designed to actuate the drive element 20 such that the pivoting movement of the door 3 is effected. The control unit 31 is also suitable for detecting a motor current I (FIG. 4) of the drive element 20. For this purpose, the control unit 31 can be coupled to the drive element 20 with the aid of a signal connection 32. The signal connection 32 can be a data line. The signal connection 32 can also be wireless. For example, the control unit 31 is designed to actuate the drive element 20 such that the door 3 executes a complete opening movement and/or a partial opening movement and/or a complete closing movement and/or a partial closing movement. For this purpose, the control unit 31 and the drive element 20 are coupled to one another in a signal-carrying manner with the aid of the signal connection 32.

For example, the household dishwasher 1 comprises a user interface 33 which is designed to communicate with the control unit 31 in order to actuate the drive element 20. A signal connection 34 is provided for this purpose. The signal connection 34 can be a data line. The signal connection 34 can also be wireless. The user interface 33 preferably comprises a pushbutton, a touch display, a microphone, a sensor or some other input facility.

As FIG. 3 shows, the drive element 20 is actively connected to the drive roller 19 with the aid of a gearing 35, in particular a worm gearing. Here, the gearing 35 is arranged between the drive element 20 and the drive roller 19. The drive roller 19 is rotated about an axis of rotation 36 with the aid of the drive element 20 and the gearing 35. The drive roller 19 for example has a rotational symmetry in respect of the axis of rotation 36.

For example, the gearing 35 is designed to inhibit the movement of the drive roller 19 if a torque is applied to the drive roller 19 from outside the gearing 35. This case can occur for example if a user opens the door 3 manually, so that the spring force F3 pulls on the second end section 26 of the cable 18 and as a result applies a torque to the drive roller 19. If such a spring force F3 for example exceeds a particular amount, the cable 18 slides over the drive roller 19. Abrasion resistance is then produced on the friction surface 24. On account of the pretensioning of the spring element 25, the spring force F3 also acts on the cable 18 when the door 3 is fully closed. Consequently, cable friction on the drive roller 19 is realized in this state, too.

Thus, with the aid of the door opening and closing device 17, on the one hand the torque of the drive element 20 is transmitted via the cable 18 or via the spring element 25 during the automatic operation of the door 3 and, on the other hand, the door is prevented from falling open in an uncontrolled manner with the aid of the cable friction during the manual operation of the door 3. A breakage or tearing of the cable 18 and/or of the spring element 25 during the automatic opening of the door 3 following an unlocking of a door safety lock 37 (FIG. 2) of the door 3 can result in said door falling into its open position without any appreciable delay and thus in an uncontrolled manner. In this case, there is a risk of injury for the user, in particular for children. This has to be prevented.

This can be prevented with the aid of a monitoring of the door opening and closing device 17. Here, this takes place with the aid of a monitoring of the motor current I of the drive element 20.

Figure 4:
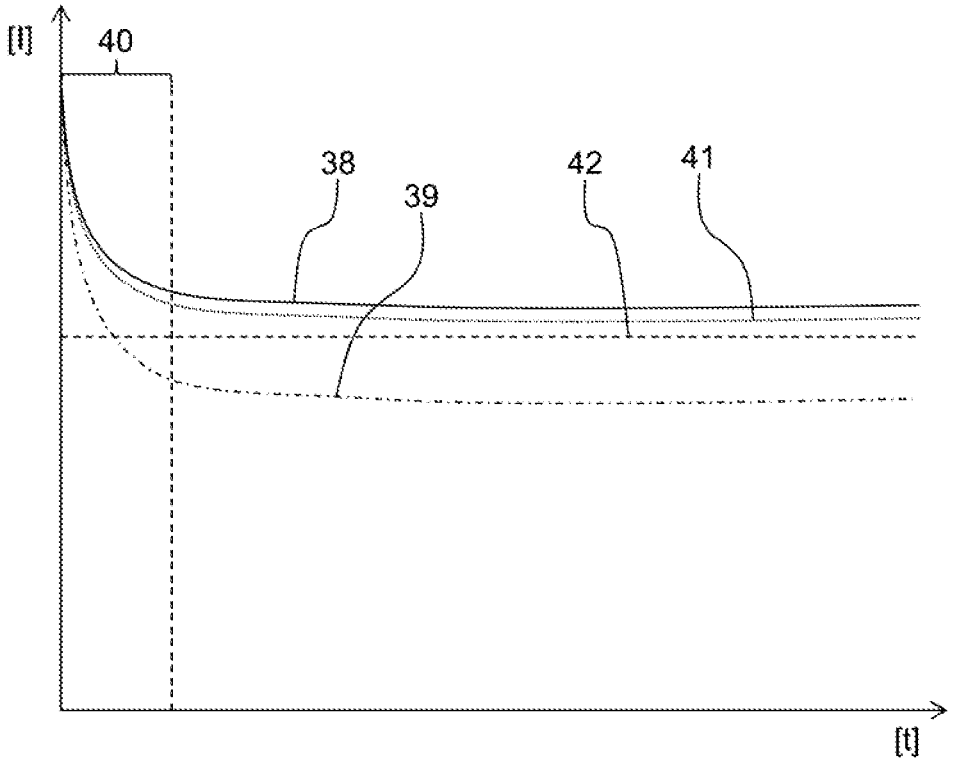
FIG. 4 shows a schematic diagram in which the motor current of a drive element is plotted over time for the household dishwasher according to FIG. 1.

FIG. 4 shows a schematic diagram in which the motor current I of the drive element 20 is plotted over the time t. As previously mentioned, the control unit 31 is suitable for detecting the motor current I of the drive element 20. To verify whether there has been a breakage of the spring element 25 and/or of the cable 18, it is possible to actuate the drive element 20 with the door 3 closed and to evaluate a motor characteristic curve 38, 39 of the drive element 20. If the door opening and closing device 17 is intact, the drive element 20 must overcome the cable frictional force in the form of a load torque. For the case that the spring element 25 and the cable 18 are intact, the motor characteristic curve is assigned the reference character 38 in FIG. 4. If the spring element 25 and/or the cable 18 is broken, the drive element 20 rotates without a load torque. In FIG. 4, the motor characteristic curve is designated with the reference character 39 in the case of a broken spring element 25 and/or cable 18.

The control unit 31 detects the motor current I or the motor characteristic curve 38, 39. The control unit 31 is also suitable for evaluating the motor current I or the motor characteristic curve 38, 39. The evaluation can take place in that a starting current 40 occurring in the motor characteristic curve 38, 39 during startup of the drive element 20 is not used to assess whether or not there has been a breakage of the spring element 25 and/or of the cable 18.

Furthermore, for example during a calibration of the door opening and closing device 17, a reference motor characteristic curve 41 can be detected and stored in the control unit 31. In this case, the control unit 31 compares the respective motor characteristic curve 38, 39 with the reference motor characteristic curve 41. The calibration can be carried out for example at predetermined time intervals. If the motor characteristic curve 38, 39 deviates too strongly from the reference motor characteristic curve 41, it can be assumed that there has been damage to the spring element 25 and/or the cable 18. The permissible deviation of the motor characteristic curve 38, 39 from the reference motor characteristic curve 41 can be stored in a tolerance range in the control unit 31.

Furthermore, a limit value 42 of the motor current I can be stored in the control unit 31. If the motor characteristic curve 38 lies above the limit value 42, it can be assumed that the spring element 25 and the cable 18 are intact. If the motor characteristic curve 39 lies below the limit value 42, it can be assumed that there has been a breakage of the spring element 25 and/or of the cable 18. In this case, a corresponding notification, in particular a warning signal, can be output for example via the user interface 33. Furthermore, the notification can also cause the automated opening of the door 3 to be deactivated. It is thus possible to dispense with the monitoring of the spring element 25 and/or of the cable 18 with the aid of an additional switch or sensor.

This evaluation of the motor current I is generally possible in both directions of rotation of the drive element 20. It is however preferable for the motor current I to be evaluated in the closing direction of the door 3, in which case a door seal disposed circumferentially around the loading opening 6 acts as the stop for the movement of the door 3. A prerequisite for the evaluation of the motor current I in the opening direction of the door 3 is that the door safety lock 37 is not unlocked.

Not only is it possible to use the monitoring of the motor current I to monitor the spring element 25 and/or the cable 18, but it is also possible to monitor for example whether or not the door 3 is fully opened. In this case, the door 3 rests on a mechanical stop in its fully opened state. There is then a peak in the course of the motor current I, which can be used to assess whether or not the door 3 is fully opened. As a result, it is possible to dispense with an additional final position switch, which can be used to monitor a final position of the door 3. Furthermore, the measurement of the motor current I can be carried out continuously during a closing procedure or an opening procedure of the door 3.

Figure 5:
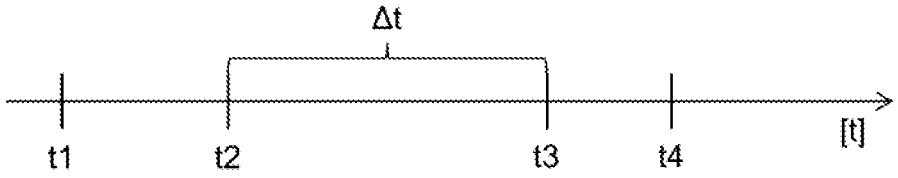
FIG. 5 shows a schematic timeline of an opening and closing procedure of a door of the household dishwasher according to FIG. 1.

FIG. 5 shows schematically, on the basis of an exemplary timeline, how the monitoring of the motor current I can be carried out. At a time instant t1, the door 3 is opened manually or automatically. At a time instant t2, the door 3 is closed again manually or automatically. Immediately after the closing of the door 3, in other words at the time instant t2, the drive element 20 is actuated and the motor current I monitored. If the spring element 25 and the cable 18 are intact, the motor characteristic curve 38 according to FIG. 4 is produced. If the spring element 25 and/or the cable 18 is broken, the motor characteristic curve 39 according to FIG. 4 is produced. In this case, the control unit 31 outputs the notification that the spring element 25 and/or the cable 18 are damaged.

The door 3 is opened again manually or automatically at a time instant t3. Over a period Δt between the time instant t2 and the time instant t3, no monitoring of the motor current I takes place because the spring element 25 is free from tension apart from its pretensioning during this period Δt. Because a breakage of the spring element 25 and/or of the cable 18 is thus highly unlikely during the period Δt, it is possible to dispense with a monitoring of the motor current I. At a time instant t4, the door 3 is closed again manually or automatically. Immediately after the closing of the door 3 at the time instant t4, the motor current I is analyzed as explained previously.

In addition, with the aid of a continuous monitoring of the motor current I, it is also possible to identify other wear and tear of the door opening and closing device 17, which manifests itself as an increased take-up of the motor current I of the drive element 20, and to output a corresponding notification to the user.

Figure 6:
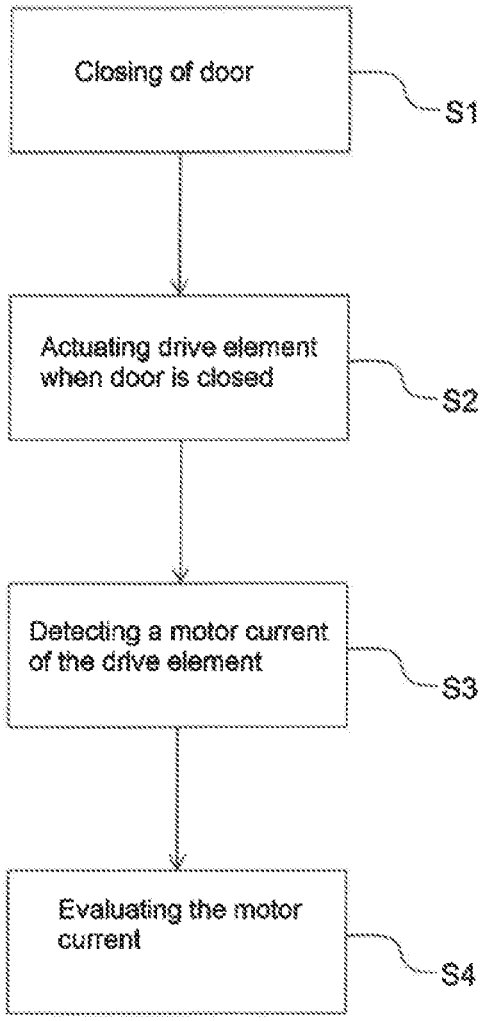
FIG. 6 shows a schematic block diagram of an embodiment of a method for operating the household dishwasher according to FIG. 1.

FIG. 6 shows a schematic block diagram of an embodiment of a method for operating the household dishwasher 1. In a step S1, the door 3 is closed manually or automatically. In a step S2, the drive element 20 is actuated with the aid of the control unit 31 when the door 3 is closed. At the same time, in a step S3, the motor current I or the motor characteristic curve 38, 39 of the drive element 20 is detected. In a step S4, the motor current I or the motor characteristic curve 38, 39 is evaluated by the control unit 31 in order to establish whether the door opening and closing device 17 is functional or non-functional. The door opening and closing device 17 is non-functional for example in the event of a breakage of the spring element 25 and/or the cable 18.

As previously mentioned, it is advantageously possible to dispense with a separate switch or sensor for monitoring the door opening and closing device 17 or the spring element 25 and/or the cable 18 in the household dishwasher 1.

Although the present invention has been described with reference to exemplary embodiments, it can be modified in numerous different ways.

The invention claimed is:

1. A household dishwasher, comprising:

a dishwasher cavity;

a door attached pivotably to the dishwasher cavity;

a door opening and closing device for automated opening and closing of the door; and a control unit designed to actuate the door opening and closing device, said control unit designed to detect a motor current of a drive element of the door opening and closing device and to evaluate the detected motor current as to whether the door opening and closing device is functional or non-functional.

2. The household dishwasher of claim 1, wherein the control unit is designed to output a signal and/or to deactivate the door opening and closing device when the door opening and closing device is non-functional.

3. The household dishwasher of claim 1, wherein the door opening and closing device includes a cable coupled to the door and a spring element coupled to the cable, said control unit designed to evaluate the motor current in order to establish whether at least one of the cable and the spring element is functional or non-functional.

4. The household dishwasher of claim 3, further comprising a drive roller driven by the drive element, said cable being wrapped around the drive roller and driven by the drive roller.

5. The household dishwasher of claim 1, wherein the control unit is designed to actuate the drive element in a closed state of the door and to detect and evaluate the motor current in the closed state of the door.

6. The household dishwasher of claim 1, wherein the control unit is designed to compare a motor characteristic curve of the drive element with at least one member selected from the group consisting of a reference motor characteristic curve stored in the control unit and a limit value stored in the control unit, and to identify, as a function of a deviation of the motor characteristic curve from the member, whether the door opening and closing device is functional or non-functional.

7. The household dishwasher of claim 1, further comprising a user interface designed to operate the door opening and closing device and to output a signal indicating whether the door opening and closing device is functional or non-functional.

* * * * *